US005833217A

United States Patent [19]

Goldsby

[11] Patent Number: 5,833,217

[45] Date of Patent: Nov. 10, 1998

[54] DETACHABLE TWO-HANDED CRANK HANDLE FOR NAUTICAL WINCH

[76] Inventor: Alan T. Goldsby, 24100 Inkster Rd., Southfield, Mich. 48034

[21] Appl. No.: 755,178

[22] Filed: Nov. 25, 1996

[51] Int. Cl.[6] ..... B66D 1/00

[52] U.S. Cl. ..... 254/266; 74/545; 81/35; 81/73

[58] Field of Search ..... 74/545, 548; 81/73, 81/28, 35; 254/342, 344, 266

[56] References Cited

U.S. PATENT DOCUMENTS

| | | | |
|---|---|---|---|
| 89,925 | 5/1869 | Fray | 81/35 |
| 332,996 | 12/1885 | Coon | 74/545 |
| 1,053,536 | 2/1913 | Sargent | 81/73 |
| 1,401,615 | 12/1921 | Lawrence | 81/73 |
| 1,409,510 | 3/1922 | Adams | 81/73 |
| 1,500,069 | 7/1924 | Gould | 81/35 |
| 1,688,776 | 10/1928 | Barber . | |
| 1,714,361 | 5/1929 | Gougler | 81/35 |
| 1,938,140 | 12/1933 | Elisius . | |
| 3,051,445 | 8/1962 | Moulton . | |
| 3,167,338 | 1/1965 | Troike | 287/119 |
| 3,391,907 | 7/1968 | Vogelsang . | |
| 3,865,500 | 2/1975 | Newell | 74/545 |
| 4,037,489 | 7/1977 | Morel . | |
| 4,338,827 | 7/1982 | Hooker . | |
| 4,391,432 | 7/1983 | Baud . | |
| 4,531,715 | 7/1985 | Wiens . | |
| 4,582,298 | 4/1986 | Boome et al. . | |
| 4,791,828 | 12/1988 | Kaye . | |
| 4,815,709 | 3/1989 | Hockett . | |
| 4,883,255 | 11/1989 | Bacon . | |
| 5,048,799 | 9/1991 | Aronowitsch . | |
| 5,255,573 | 10/1993 | Estabrook . | |
| 5,301,389 | 4/1994 | Engel et al. . | |
| 5,394,815 | 3/1995 | Hansen . | |

*Primary Examiner*—Katherine Matecki
*Attorney, Agent, or Firm*—John B. Benefiel

[57] ABSTRACT

A double throw crank handle for a nautical winch has a first lever extending radially out from a winch axis and having a first grip at the outward end. A second lever is connected to the outward end of the first lever and extends parallel back over the winch axis to locate an opposite end a similar radially offset distance from the winch axis. A second grip extends up from the second lever opposite end. A locking mechanism to hold the crank handle in the winch socket is mounted below the first lever plug end. Counterbalanced two handed cranking about a winch axis is executed in winding the winch using the double throw crank handle.

9 Claims, 2 Drawing Sheets

DETACHABLE TWO-HANDED CRANK HANDLE FOR NAUTICAL WINCH

BACKGROUND OF THE INVENTION

This invention concerns onboard nautical winches which are used on sailboats for various purposes such as to adjust the trim of the sails. One type of nautical winch is used to trim the sails by winding up or paying out a sheet attached to a sail. Such winches are mounted with the winch axis extending vertically, and a crewman operates the winch by winding a detachable crank handle in a horizontal plane. The handle must be detachable in order to allow manual winding of the line when considerable slack must be wound onto the winch capstan and to facilitate disengagement of the line from the winch capstan for tacking. Also, the crank handle is necessarily of substantial diameter in order to provide sufficient leverage. Speed is critical particularly in racing situations, and thus adequate leverage necessitates a large crank offset distance.

The resulting substantial size of the crank handle creates an obstruction when the handle is installed, and the swing of a large crank handle creates a clumsy motion. In an effort to improve the torque which can be exerted to speed up sheet windup and reduce the size of the crank handle, double handles have heretofore been mounted on a winch crank arm.

However, the crewman must still move both his or her hands from one side to the other across the large swing of the handle, creating an unbalanced movement which impedes rapid winching. This is contrasted with the horizontal axis "grinder" winches which can be efficiently operated, but which cannot be used for the purpose described.

Offset two-handed crank handles have heretofore been employed for such applications as awning drives, jack handles, etc., but such arrangements have required long rods which are tilted and oscillate with respect to the axis of winding. This could not be done with a nautical winch as a practical matter since the winding motion of necessity would need to be done at an excessive height above the winch.

The object of the present invention is to provide an improved winch crank handle which achieves enhanced ergonomics over prior vertical axis nautical winch crank handles, allowing the user to remain more balanced while using both hands to greatly improve the speed of operation and at the same time reducing the effort required.

SUMMARY OF THE INVENTION

The above object is achieved by a double throw crank handle in which two grips are provided, each on one of a respective pair of crank levers extending to opposite sides of the drive axis of the winch. A first revolvable grip is supported on a first crank lever which has a winch drive feature mounted on an inside end, the drive feature adapted to be detachably fit in a drive socket of the winch. The first grip is rotatable on the outboard end of the first lever.

A second lever is attached at one end to the outboard end of the first lever but spaced vertically thereabove so as to accommodate the first revolvable grip. The second lever extends parallel to the first lever back across the winch axis to the opposite side thereof, with a second end preferably located a distance from the drive axis equal to the offset of the outboard end of the first lever.

A second upwardly projecting revolvable grip is mounted to the second end of the second lever.

The double throw crank handle is operated with a respective grip in each hand, which each sweep back and forth across the winch axis as the arms of the operator cross and uncross as each hand moves with a respective grip.

Both arms can thus be very efficiently exerted to operate the winch, with the forces of each hand balanced allowing the operator to maintain his or her balance without effort to provide an ergonomically efficient operation.

The increased effort able to be exerted by two hands allows a shorter maximum radius of the levers, reducing the bulk of the crank handle and also affording a more compact motion which also adds ergonomic benefits.

This design enables more rapid operation of a nautical winch to enhance the crew performance particularly in competitive sailing events.

The improved ergonomics of the crank handle design according to the invention reduces the overall effort required in any situation.

The crank handle is preferably releasably locked to the winch by a mechanism located beneath the first lever leaving the space between the two levers unobstructed and allowing free movement of the hand, wrist, and arm during operation of the crank handle.

The locking mechanism can take the form of a spring-loaded rotary plate which is released after insertion into the winch opening, producing a misalignment of the plate with the socket splines to releasably retain the crank handle.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
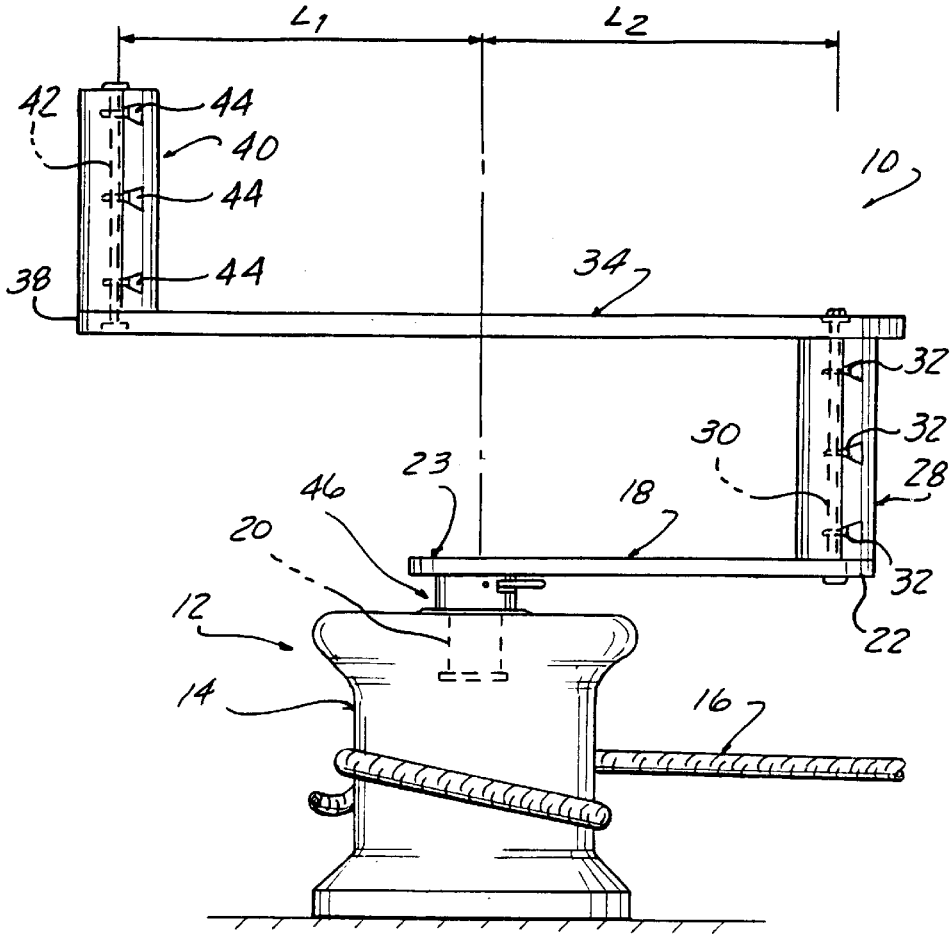
FIG. 1 is a perspective separated view of the crank handle and winch shown in FIG. 1.
Figure 3:
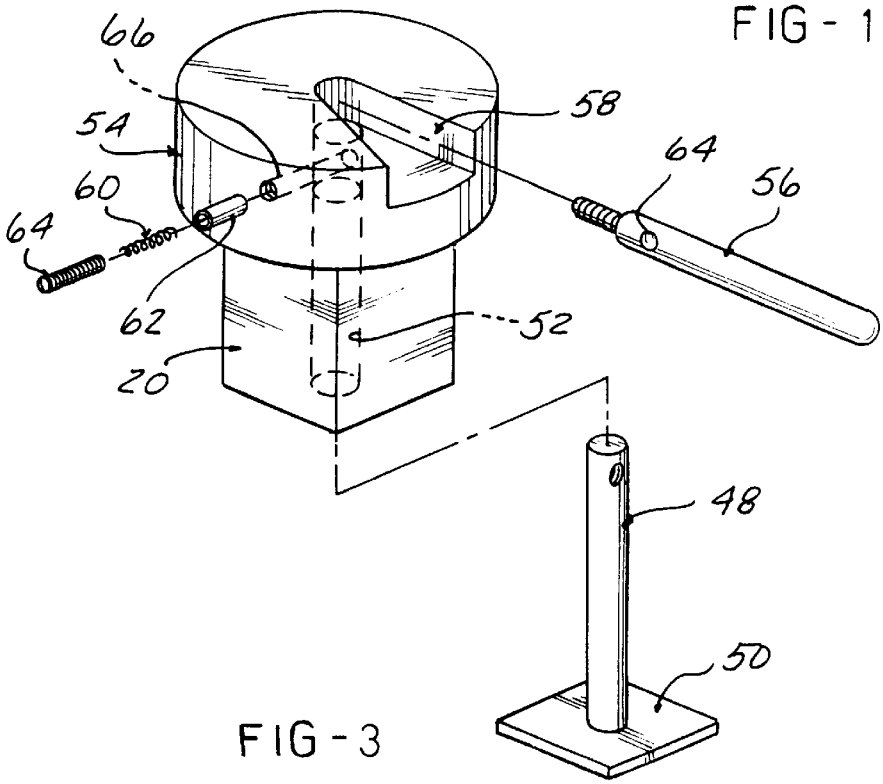
FIG. 3 is an exploded perspective view of the locking mechanism components.
Figure 2:
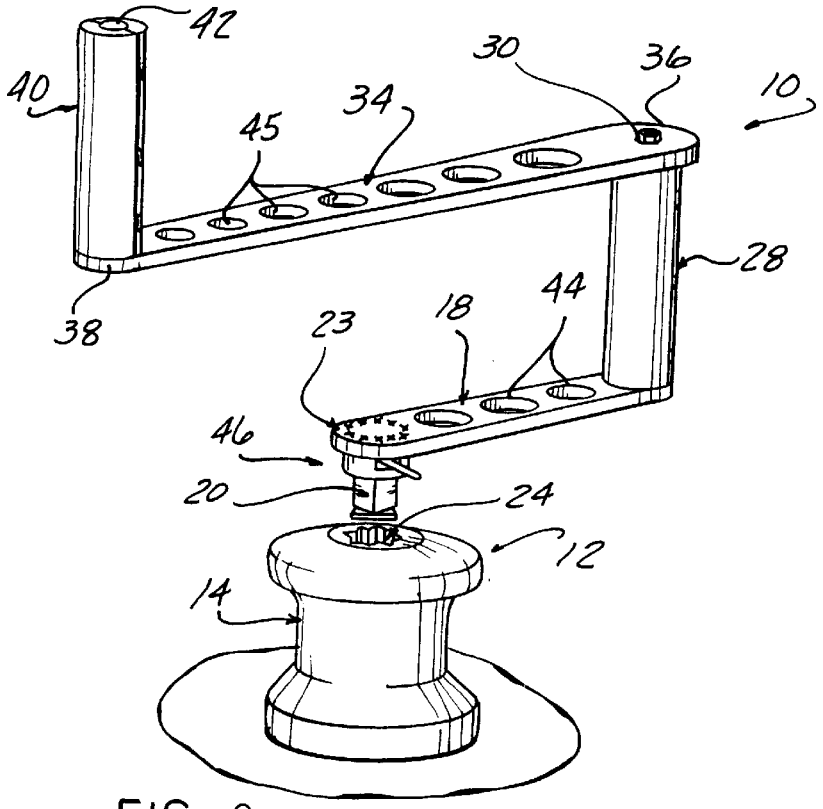
FIG. 2 is a perspective separated view of the crank handle and winch shown in FIG. 1.
Figure 4:
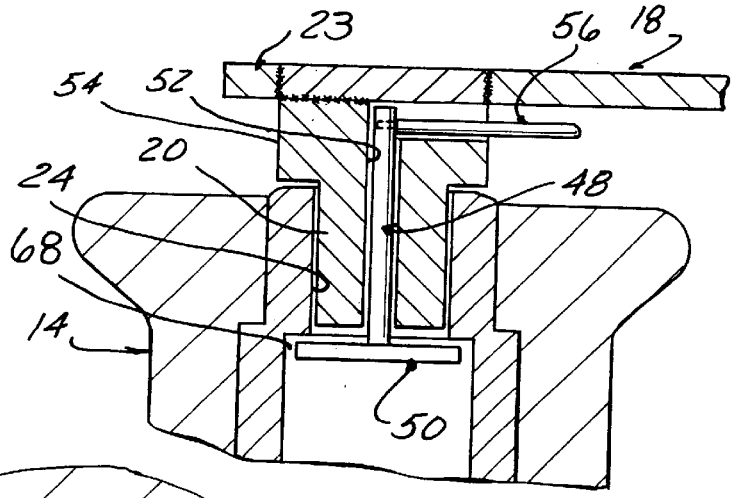
FIG. 4 is a partially sectional view taken through the mating portion of the crank handle and locking mechanism, and top portion of a winch receiving the crank handle.

Referring to FIGS. 1 and 2, the crank handle 10 according to the present invention is shown utilized for a manual drive for a conventional vertical axis nautical winch 12 having a rotatably mounted capstan body 14 on which is wound a sheet 16 attached to a sail (not shown) in the well known manner. The crank handle 10 can also be used with nautical winches disposed by winding about horizontal or tilted axes.

The crank handle 10 is of a double throw construction, comprised of a first lever 18 having a winch socket drive feature, shown as a square plug 20, fixedly attached beneath the inboard first end 23 of the first lever 18.

The square plug 20 is configured to be received in a winch socket 24 having eight angled spline grooves 26 (FIG. 5) such that the corners of the plug 20 can be received in four of the grooves 26 in various rotated installed positions of the crank handle 10.

This mating engagement establishes a positive drive connection for rotation of the socket and winch capstan 14 about a vertical axis.

The other outboard end of the crank handle first lever 18 mounts a first revolvable grip 28 projecting vertically up therefrom. A stud 30 can be welded or otherwise fixed to the outboard end of the first lever 18, with the grip 28 constructed in two plastic semicylindrical halves held together with screws 32 received in tangential grooves. Other alternate designs are possible such as a one piece molded grip mounted over a stud which is demountable.

The crank handle 10 further includes a second lever 34 mounted above and parallel to the first lever 18 a distance of several inches, i.e., five or six inches to comfortably receive one hand of the user. The second lever 24 extends transversely back across the winch axis at the center of the drive feature. One end 36, aligned above opposite the end 22 of the first lever 18, also mounts the first grip 28 fixing the upper end of the stud 30.

The opposite end 38 of the second lever 34 has a second grip 40 revolvably mounted thereon, projecting upwardly on a stud 42 fixed thereto. A two-piece grip construction may be used, screws 44 used to connect the halves surrounding the stud 42, as with the first grip 28.

Both levers 18 and 34 are constructed of flat bars having their flat sides parallel to each other, preferably lightened by a series of cutout holes 45 distributed along the length of each lever.

The outward radial spacing $L_1$, $L_2$ of each grip 28, 40 is preferably equal to establish equal leverage and a balanced loading.

A locking mechanism 46 is mounted below the inboard end 22 of the first lever 18 which releasably retains the crank handle 10 in the winch socket 24. The locking mechanism 46 includes a pivot pin 48 having a square plate 50 fixed at one end, square plate 50 being matched to the cross section of square plug 20 so as to also be able to pass into the socket 24 with each corner in a respective slot 26.

Pin 48 can oscillate in a bore 52 extending through square plug 20 and a cylindrical plug 54 above the square plug 20.

An operating pin 56 is threaded into the end of the pin 48 and projects radially out through a wedge-shaped opening 58 in the cylindrical plug 54. A bias spring 60 is installed in a bore 66 extending crossways to the operating pin 56 and urges a dowel 62 to engage a flat 64 on one side of the operating pin 56.

An Allen screw 64 threaded into bore 66 compresses spring 60.

Figure 5:
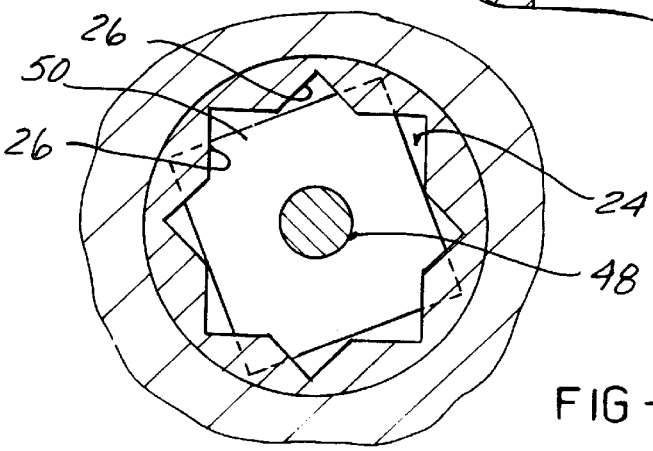
FIG. 5 is a transverse sectional view taken through the winch top and locking mechanism showing the released locking position of the locking plate component.

Pin 56 is thus urged to one side of wedge-shaped opening 58. In this position, square plate 50 is misaligned with the square plug 20, as shown in FIG. 5.

The pin 56 may be pulled to the other side, positioning the square plate 50 in alignment with square plug 20, allowing both to be inserted into socket 24.

An enlarged space 66 beneath socket 24 allows the plate 50 to rotate to a misaligned position when pin 56 is released, locking the crank handle 10 inserted in the winch socket 24.

A user grasps each grip 28, 40 in a respective hand to rotate the crank handle 10. The winding motion produced by the double throw configuration counterbalances the forces involved so that the user need not strain to maintain his or her balance even while vigorously executing a winding motion.

The ability to efficiently exert both hands to rotate the crank handle 10 reduces the peak effort by either hand and allows faster winding since the levers can be shorter, reducing the range of motion required.

This also reduces the radial size of the crank handle, making it less bulky and less obtrusive when installed. The distances $L_1$ and $L_2$ need only be about seven inches for the heaviest duty application.

A two-handed counter motion is produced, with each hand constantly moving to diametrically opposite locations on either side of the winch axis. This motion has been found to be very ergonomically beneficial. At the same time, the compact crank handle is disposed immediately above the winch.

A handicapped user who cannot user his or her lower body is particularly assisted by the crank handle according to the invention since reaction forces are avoided and thus the person's body stays in position during cranking.

The levers shown are preferably made flat bars of steel, as the crank handle can be manufactured at relatively low cost. However, molded composites may also be used, as the high strength afforded by such modern materials can allow curved shapes and offsets.

We claim:

1. In combination with a nautical winch of the type including a capstan mounted for rotation about a fixed axis and having a socket for engagement with a crank handle;

a double throw two-handed crank handle comprising:

a drive plug configured to be detachably received in said socket and to establish a rotary driving connection between said crank handle and said winch;

a first lever having said drive plug attached at a first end of said first lever;

a grip projecting above an opposite end of said first lever located radially outboard from said winch axis;

a second lever parallel to said first lever and connected at one end to said opposite end of said first lever and spaced away from said first lever with said first grip interposed therebetween;

said second lever extending across said winch axis to locate an opposite end of said second lever diametrically opposite said opposite end of said first lever; and, a second grip projecting upwardly from said opposite end of said second lever and mounted thereto.

2. The combination of a nautical winch and a crank handle according to claim 1 wherein each of said grips is revolvably mounted.

3. The combination of a nautical winch and a crank handle according to claim 1 wherein each of said grips is located substantially equal radial distances outward from said winch axis.

4. The combination of a nautical winch and a crank handle according to claim 2 wherein a stud is fixed extending between said outward end of said first lever, and said one end of said second lever and said first grip is revolvable on said stud.

5. The combination of a nautical winch and a crank handle according to claim 1 further including a locking mechanism mounted below said first end of said first lever.

6. The combination of a nautical winch and a crank handle according to claim 1 wherein said second lever is spaced away from said first lever a distance sufficient to comfortably receive one hand of a user.

7. The combination of a nautical winch and a crank handle according to claim 1 wherein said first lever opposite end and said second lever opposite end are each spaced approximately equal distances out from said winch axis.

8. The combination of a nautical winch and a crank handle according to claim 7 wherein said first lever outward end and said second lever opposite end are spaced no more than about seven inches from said winch axis.

9. The combination of a nautical winch and a crank handle according to claim 1 wherein said first and second levers comprise bars having flat sides parallel to each other.

* * * * *